US011401489B2

(12) United States Patent
Depoot et al.

(10) Patent No.: US 11,401,489 B2
(45) Date of Patent: Aug. 2, 2022

(54) WATER-SOLUBLE MULTICOMPARTMENT UNIT DOSE ARTICLE

(71) Applicant: The Procter & Gamble Company, Cincinnati, OH (US)

(72) Inventors: Karel Jozef Maria Depoot, Anzegem-Vichte (BE); Nikola Curcic, Mechelen (BE); Katrien Andrea Lieven Van Elsen, Puurs (BE); Jack Wesley English, III, West Chester, OH (US); Gary James Dechert, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 146 days.

(21) Appl. No.: 16/666,452

(22) Filed: Oct. 29, 2019

(65) Prior Publication Data

US 2020/0131457 A1 Apr. 30, 2020

(30) Foreign Application Priority Data

Oct. 30, 2018 (EP) ..... 18203471

(51) Int. Cl.

| | |
|---|---|
| ***C11D 17/04*** | (2006.01) |
| ***C11D 3/37*** | (2006.01) |
| ***C11D 3/43*** | (2006.01) |
| ***C11D 11/00*** | (2006.01) |

(52) U.S. Cl.

CPC ..... *C11D 17/045* (2013.01); *C11D 3/3753* (2013.01); *C11D 3/43* (2013.01); *C11D 11/0017* (2013.01)

(58) Field of Classification Search

None

See application file for complete search history.

(56) References Cited

U.S. PATENT DOCUMENTS

| | | | | |
|---|---|---|---|---|
| 6,184,188 | B1 * | 2/2001 | Severns | C07C 69/738 510/505 |
| 6,878,679 | B2 | 4/2005 | Sommerville-Roberts et al. | |
| 7,517,847 | B2 | 4/2009 | Catalfamo | |
| 8,905,236 | B2 | 12/2014 | Denome | |
| 2002/0123444 | A1 * | 9/2002 | Fisher | B65D 77/04 510/297 |
| 2003/0050209 | A1 | 3/2003 | Perkis et al. | |
| 2011/0188784 | A1 | 8/2011 | Denome | |
| 2012/0159718 | A1 | 6/2012 | Catlin et al. | |
| 2013/0065811 | A1 * | 3/2013 | Fernandez-Prieto | C11D 17/003 510/375 |
| 2013/0203647 | A1 | 8/2013 | Uchegbu | |
| 2015/0267155 | A1 | 9/2015 | Brooker | |
| 2015/0267156 | A1 | 9/2015 | Brooker | |
| 2016/0215243 | A1 * | 7/2016 | Himmrich | C11D 3/39 |
| 2017/0006700 | A1 | 1/2017 | Kim | |
| 2017/0067001 | A1 | 3/2017 | Souter | |
| 2017/0067003 | A1 | 3/2017 | Souter et al. | |
| 2017/0349863 | A1 | 12/2017 | Brooker | |
| 2021/0102147 | A1 * | 4/2021 | Meier | B29O 66/73793 |

FOREIGN PATENT DOCUMENTS

| | | |
|---|---|---|
| WO | WO03044155 A1 | 5/2003 |

OTHER PUBLICATIONS

CM05042F EP Search Report for appl. No. 18203471.0-1105, dated May 8, 2019, 7 pages.

Extended European Search Report and Search Opinion; Application No. 19205911.1; dated Mar. 30, 2020; 8 pages.

International Search Report and Written Opinion; Application Ser. No. PCT/US2019/058425; dated Jan. 20, 2020, 14 pages.

* cited by examiner

*Primary Examiner* — Lorna M Douyon

(74) *Attorney, Agent, or Firm* — Gregory S. Darley-Emerson

(57) ABSTRACT

A water-soluble multicompartment unit dose article having a weight ratio of laundry detergent to total water-soluble film in the water-soluble multicompartment unit dose article of at least 45:1.

19 Claims, 1 Drawing Sheet

WATER-SOLUBLE MULTICOMPARTMENT UNIT DOSE ARTICLE

FIELD OF THE INVENTION

A water-soluble multicompartment unit dose article having a weight ratio of laundry detergent to total water-soluble film in the water-soluble multicompartment unit dose article of at least 45:1.

BACKGROUND OF THE INVENTION

Water-soluble unit dose articles are liked by consumers as they are convenient and efficient to use. Such water-soluble unit dose articles often comprise laundry detergent compositions. Without wishing to be bound by theory, each unit dose article in principle provides sufficient laundry detergent composition to wash a single load of laundry. However, a large variety of washing machines with a wide spread of possible load sizes co-exist in market. The wash conditions are influenced by the level of soil and also the types of fabrics being washed. Therefore, detergent manufacturers typically develop water soluble unit dose articles targeting average load sizes, for example, 6 to 8 kg, with moderate soil levels. For large laundry loads and/or heavily soiled fabrics, typically the use of two such unit dose articles are recommended as this will provide a larger volume of laundry detergent composition.

However, an issue that may be encountered by consumers using two unit dose articles as currently available is that residues are observed on the fabrics following the wash operation. It is expected that such incidents might further increase with the emerging sustainability trend of short and/or low water and/or low temperature cycles. Consumers do not like such residues on fabrics and tend to re-wash the fabrics which is inconvenient to the consumer and costly and wasteful.

Therefore, there is a need for a means to allow consumers to wash larger laundry loads and/or heavily soiled fabrics with larger detergent loads using multi-compartment water-soluble unit dose articles whilst reducing instances of residues on fabrics.

It was surprisingly found that a multi-compartment water-soluble unit dose article according to the present invention overcame this issue.

SUMMARY OF THE INVENTION

A first aspect of the present invention is a water-soluble multicompartment unit dose article, wherein the water-soluble multicompartment unit dose article comprises;

between 35 g and 75 g, preferably between 40 g and 60 g of a laundry detergent composition, wherein the laundry detergent composition is the total laundry detergent composition present across all the compartments present and the laundry detergent composition is a liquid, a powder, or a mixture thereof; and at least a first water-soluble film and a second water-soluble film, wherein the first and second water-soluble films are sealed together to create sealed film and wherein the sealed film defines at least a first internal compartment and a second internal compartment; and wherein, the weight ratio of laundry detergent to total water-soluble film in the water-soluble multicompartment unit dose article is at least 45:1, preferably between 45:1 and 70:1, more preferably between 45:1 and 60:1.

A second aspect of the present invention is use of a water-soluble unit dose article according to the present invention to reduce instances of residues on fabrics following a fabric wash operation.

DETAILED DESCRIPTION OF THE INVENTION

Water-Soluble Multicompartment Pouch

Figure 1:
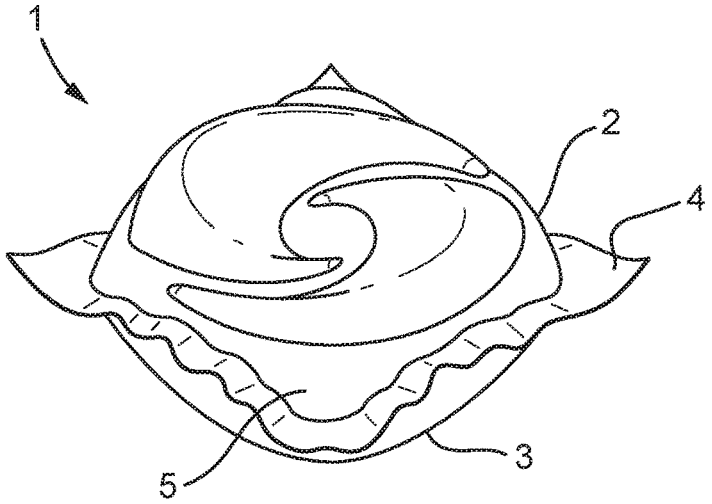
FIG. 1 is a water-soluble unit dose article according to the present invention.

The present invention is a water-soluble multicompartment unit dose article comprising a water-soluble film and a laundry detergent composition. The water-soluble film is described in more detail below. The laundry detergent composition is described in more detail below.

The water-soluble unit dose article comprises at least a first water-soluble film and a second water-soluble film, wherein the first and second water-soluble films are sealed together to create sealed film and wherein the sealed film defines at least a first internal compartment and a second internal compartment. At least one compartment comprises the laundry detergent composition, however the laundry detergent composition may be comprised in at least two compartments or even at least three compartments. The water-soluble film is sealed such that the liquid laundry detergent composition does not leak out of the compartments during storage. However, upon addition of the water-soluble unit dose article to water, the water-soluble film dissolves and releases the contents of the internal compartment into the wash liquor.

Each compartment should be understood as meaning a closed internal space within the unit dose article, which holds the laundry detergent composition. The unit dose article is manufactured such that the water-soluble films completely surround the laundry detergent composition and in doing so defines the compartment in which the laundry detergent composition resides. The film is described in more detail below.

The unit dose article comprises at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment but does not completely enclose the second compartment. Alternatively, one compartment may be completely enclosed within another compartment.

One of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the laundry detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms, for example liquid or powder. The weight ratio of laundry detergent to total water-soluble film in the water-soluble multicompartment unit dose article is at least 45:1, preferably between 45:1 and 70:1, more preferably between 45:1 and 60:1. By 'total water-soluble film', we herein mean all the film used to make the water-soluble unit dose article. For example, if the water-soluble unit dose article comprises two films, then the weight ratio is based on the total weight of film in both the first and second films combined. By laundry detergent we herein mean the weight of laundry detergent composition should be calculated as all laundry detergent composition present across all the compartments and not calculated as the weight of laundry detergent composition in one compartment only. The water-soluble unit dose article comprises between 35 g and 75 g, preferably between 40 g and 60 g of a laundry detergent, preferably all liquid laundry detergent. The water-soluble unit dose article may comprise between 35 ml and 75 ml, preferably between 40 ml and 60 ml of a liquid laundry detergent.

Preferably, the weight ratio of laundry detergent composition to total sealed film is at least 150:1, preferably at least 160:1, more preferably between 180:1 and 300:1, most preferably between 200:1 and 250:1. By 'total sealed film' we herein mean the weight of all film present in the water-soluble unit dose article that is present in the seal area. The seal area may include a flange area or may be devoid of a flange area. A flange area is arranged around the perimeter of the water-soluble multicompartment unit dose article, and the flange comprises sealed film from at least the first water-soluble film and the second water-soluble film. In other words, the flange area protrudes out from the water-soluble unit dose article and comprises sealed film. By 'seal area' we herein mean areas of film sealed together to define the individual compartments. The seal area includes both the inner seal area as defined as the areas of film sealed together to define the individual compartments without the presence of a flange as well as the outer seal area defining a flange (if present) of the water-soluble unit dose article. Herein the flange excludes the inner seal areas.

FIG. 1 discloses a water-soluble unit dose article (1) according to the present invention. The water-soluble unit dose article (1) comprises a first water-soluble film (2) and a second water-soluble film (3) which are sealed together. Unit dose article (1) also includes a flange (4). The laundry detergent composition (5) is comprised within the water-soluble soluble unit dose article (1).

Figure 2:
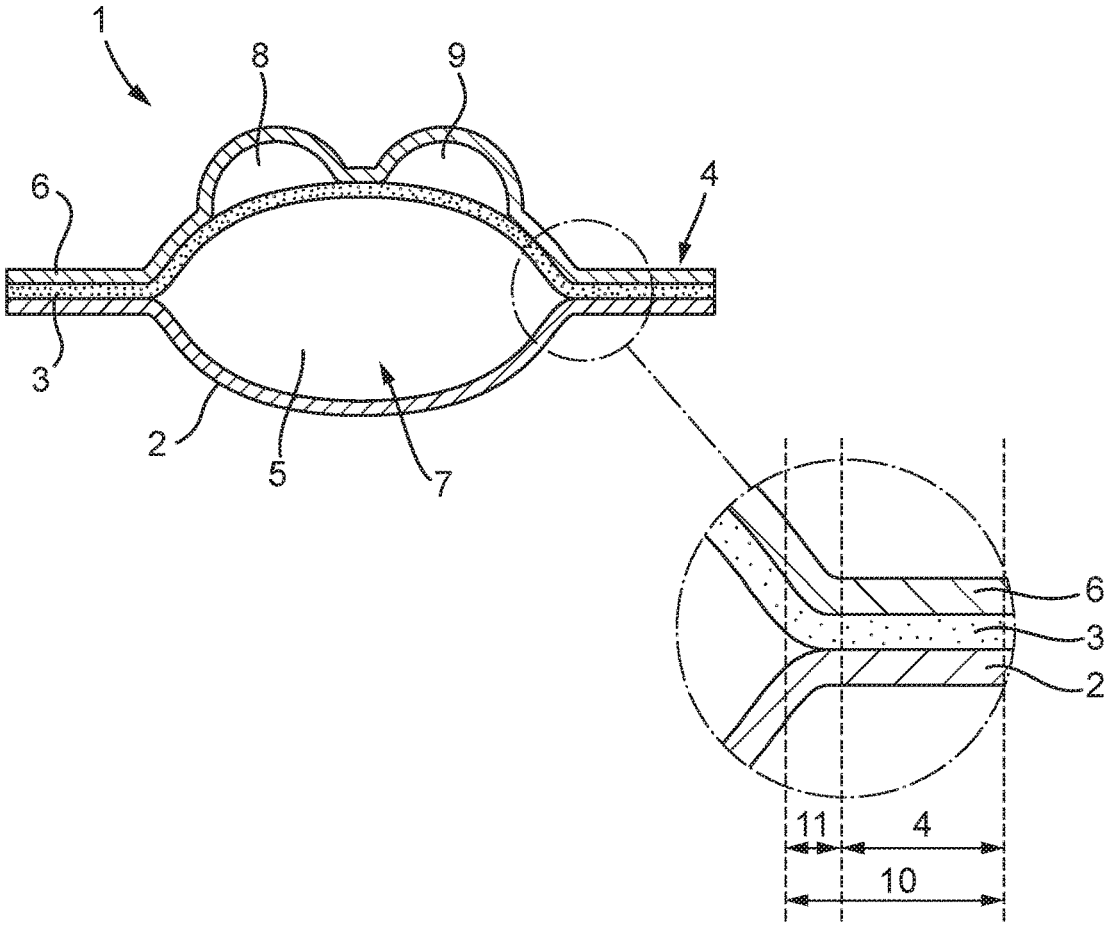
FIG. 2 discloses a cross-sectional view of a water-soluble unit dose article according to the present invention

FIG. 2 discloses a cross-sectional view of a water-soluble unit dose article according to the present invention (1). The cross-section discloses the first water-soluble film (2), the second water-soluble film (3) and a third water-soluble film (6). The water-soluble unit dose article (1) comprises a first compartment (7), a second compartment (8) and a third compartment (9). The water-soluble unit dose article (1) comprises a seal area (10), which comprises an inner seal area (11) and a flange (4). The second water-soluble film (3) and the third water-soluble film (6) are sealed together to define the second compartment (8) and the third compartment (9).

Preferably, the weight ratio of laundry detergent composition to total sealed film in the flange is at least 175:1, preferably at least 200:1, more preferably between 225:1 and 400:1, most preferably between 250:1 and 300:1.

Preferably, the water-soluble multicompartment unit dose article comprises at least a third water-soluble film wherein at least the first water-soluble film, the second water-soluble film and the third water-soluble film are sealed together to create sealed film, for example to create a so-called superposed multi-compartment water-soluble unit dose article, in which one of the at least 3 films will act as a middle film to physically separate the superposed compartment(s) from the bottom compartment(s). The water soluble unit dose article might comprise 4 water soluble films, in which 2 water soluble films are partially or fully sealed together to form a middle film to physically separate the superposed compartment(s) from the bottom compartment(s). Preferably the water-soluble unit dose article comprises exactly 3 water-soluble films, more preferably exactly 3 water-soluble films defining a superposed multi-compartment water-soluble unit dose article. Preferably, the flange comprises sealed film from at least the first water-soluble film, the second water-soluble film and the third water-soluble film. The inner seal area can be created by sealing 2 of the 3 water-soluble films together to create physically separated individual compartments or can be create by sealing the 3 films together to create physically separated individual compartments. Preferably the inner seal is created by sealing solely 2 of the 3 water soluble films together.

Preferably, the water-soluble multicompartment unit dose article including a flange has a length and a width wherein each of the length and width are independently greater than 50 mm, preferably between 50 mm and 75 mm, more preferably between 55 mm and 65 mm, preferably wherein the width to length ratio is between 0.5 and 1.5, preferably between 0.75 and 1.25, even more preferably between 0.85 and 1.15, most preferably between 0.9 and 1.1. More preferably the water-soluble multicompartment unit dose article further has a height, wherein the height is greater than 20 mm, preferably between 25 mm and 50 mm, more preferably between 30 mm and 40 mm, and wherein each of the width to height and length to height ratio including a flange independently are between 1 and 2, preferably between 1.25 and 1.9, most preferably between 1.5 and 1.8.

Preferably, the water-soluble multicompartment unit dose article excluding the presence of any flange has a length and a width wherein each of the length and width are independently greater than 45 mm, preferably between 45 mm and 70 mm, more preferably between 45 mm and 60 mm, preferably wherein the width to length ratio is between 0.5 and 1.5, preferably between 0.75 and 1.25, even more preferably between 0.85 and 1.15, most preferably between 0.9 and 1.1. More preferably the water-soluble multicompartment unit dose article further has a height, wherein the height is greater than 20 mm, preferably between 25 mm and 50 mm, more preferably between 30 mm and 40 mm, and wherein each of the width to height and length to height ratio excluding the presence of any flange independently are between 1 and 2, preferably between 1.20 and 1.8, most preferably between 1.3 and 1.6.

Without wishing to be bound by theory, multi-compartment water soluble unit dose articles have become more common within the laundry detergent market, the multi-compartment element providing formulators the flexibility of co-formulating intrinsically incompatible materials together within the same product. It is believed that the residues seen on fabrics may be at least partially due to undissolved film material. Multi-compartment water soluble unit dose articles require more sealed film and the sealed film area is the most stressed area with respect to dissolution. Therefore, undissolved film residues may be even more dominant for multi-compartment compared to single compartment water soluble articles. However, when formulating larger quantities of detergent in a single compartment water soluble article in order to reduce overall volume of film used, due to the increased weight, a higher stress is exerted on the seal area, leading to possible tears in the film or leaking water-soluble unit dose articles. It was surprisingly found that splitting of the total detergent over multiple compartments helps mitigate the increased stress as well through having less weight within the individual compartments while having more seal area to compensate the increased stress. Additionally, careful control of the weight ratio of film and sealed film to laundry detergent composition present also ensures the correct balance between reduced film volumes and ensuring structural integrity of the water-soluble unit dose article, while enabling larger amount of detergent. Furthermore, careful control of the overall size and relative dimensions of the water-soluble unit dose article also enables a balance between minimizing film use and ensuring structural integrity of the water-soluble unit dose article.

Water-Soluble Film

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Preferably, the water-soluble film comprises polyvinyl alcohol polymer or copolymer, preferably a blend of polyvinylalcohol polymers and/or polyvinylalcohol copolymers, preferably selected from sulphonated and carboxylated anionic polyvinylalcohol copolymers especially carboxylated anionic polyvinylalcohol copolymers, most preferably a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Liquid Laundry Detergent Composition

The water-soluble multicompartment unit dose article comprises between 35 g and 75 g, preferably between 40 g and 60 g of a laundry detergent wherein the laundry detergent composition is calculated as the total laundry detergent composition present cumulatively within all the compartments present. In other words, the weight of laundry detergent composition should be calculated as all laundry detergent composition present across all the compartments present and not calculated as the level of laundry detergent composition in one compartment only. The water-soluble unit dose article may comprise between 35 ml and 75 ml, preferably between 40 ml and 60 ml, of a liquid laundry detergent composition.

The laundry detergent composition may be a powder, a liquid or a mixture thereof, preferably a liquid.

The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as tablets or granules.

By powder we herein mean the laundry detergent composition may comprise solid particulates or may be a single homogenous solid. Preferably, the powder laundry detergent composition comprises particles. This means the powder laundry detergent composition comprises individual solid particles as opposed to the solid being a single homogenous solid. The particles may be free-flowing or may be compacted, preferably free-flowing.

The laundry detergent composition can be used in a fabric hand wash operation or may be used in an automatic machine fabric wash operation.

Preferably, the laundry detergent composition comprises a non-soap surfactant. The non-soap surfactant is preferably selected from non-soap anionic surfactant, non-ionic surfactant or a mixture thereof. Preferably, the laundry detergent composition comprises between 10% and 60%, more preferably between 20% and 55% by weight of the laundry detergent composition of the non-soap surfactant.

Preferably, the anionic non-soap surfactant comprises linear alkylbenzene sulphonate, alkyl sulphate, alkoxylated alkyl sulphate or a mixture thereof. Preferably, the alkoxylated alkyl sulphate is an ethoxylated alkyl sulphate.

Preferably, the laundry detergent composition comprises between 5% and 60%, preferably between 15% and 55%, more preferably between 25% and 50%, most preferably between 30% and 45% by weight of the detergent composition of the non-soap anionic surfactant.

Preferably, the non-soap anionic surfactant comprises linear alkylbenzene sulphonate and alkoxylated alkyl sulphate, wherein the ratio of linear alkylbenzene sulphonate to alkoxylated alkyl sulphate preferably the weight ratio of linear alkylbenzene sulphonate to ethoxylated alkyl sulphate is from 1:10 to 10:1, preferably from 6:1 to 1:6, more preferably from 4:1 to 1:4, even more preferably from 3:1 to 1:1. Alternatively the weight ratio of linear alkylbenzene sulphonate to ethoxylated alkyl sulphate is from 1:2 to 1:4. The alkoxylated alkyl sulphate can be derived from a synthetic alcohol or a natural alcohol, or from a blend thereof, pending the desired average alkyl carbon chain length and average degree of branching. Preferably, the synthetic alcohol is made following the Ziegler process, OXO-process, modified OXO-process, the Fischer Tropsch process, Guerbet process or a mixture thereof. Preferably, the naturally derived alcohol is derived from natural oils, preferably coconut oil, palm kernel oil or a mixture thereof.

Preferably, the laundry detergent composition comprises between 0% and 15%, preferably between 0.01% and 12%, more preferably between 0.1% and 10%, most preferably between 0.15% and 7% by weight of the laundry detergent composition of a non-ionic surfactant. The non-ionic surfactant is preferably selected from alcohol alkoxylate, Ziegler-synthesized alcohol alkoxylate, an oxo-synthesized alcohol alkoxylate, Guerbet alcohol alkoxylates, alkyl phenol alcohol alkoxylates or a mixture thereof.

Preferably, the laundry preferably liquid laundry detergent composition comprises between 1.5% and 20%, more preferably between 2% and 15%, even more preferably between 3% and 10%, most preferably between 4% and 8% by weight of the laundry detergent composition of soap, preferably a fatty acid salt, more preferably an amine neutralized fatty acid salt, wherein preferably the amine is an alkanolamine more preferably selected from monoethanolamine, diethanolamine, triethanolamine or a mixture thereof, more preferably monoethanolamine.

Preferably, the laundry detergent composition comprises a non-aqueous solvent, preferably wherein the non-aqueous solvent is selected from 1,2-propanediol, dipropylene glycol, tripropyleneglycol, glycerol, sorbitol, polypropylene glycol or a mixture thereof, preferably wherein the polypropyleneglycol has a molecular weight of 400. Preferably the liquid laundry detergent composition comprises between 10% and 40%, preferably between 15% and 30% by weight of the liquid laundry detergent composition of the non-aqueous solvent. Without wishing to be bound by theory the non-aqueous solvents ensure appropriate levels of film plasticization so the film is not too brittle and not too 'floppy'. Without wishing to be bound by theory, having the correct degree of plasticization will also facilitate film dissolution when exposed to water during the wash process.

Preferably, the liquid laundry detergent composition comprises between 0.5% and 15%, preferably between 5% and 13% by weight of the liquid laundry detergent composition of water.

Preferably, the laundry detergent composition comprises an ingredient selected from the list comprising cationic polymers, polyester terephthalates, amphiphilic graft copolymers, carboxymethylcellulose, enzymes, perfumes, encapsulated perfumes, bleach or a mixture thereof.

The laundry detergent composition may comprise an adjunct ingredient, wherein the adjunct ingredient is selected from ethanol, ethyleneglycol, polyethyleneglycol, hueing dyes, aesthetic dyes, enzymes, builders preferably citric acid, chelants, cleaning polymers, dispersants, dye transfer inhibitor polymers, fluorescent whitening agent, opacifier, antifoam, preservatives, anti-oxidants, or a mixture thereof. Preferably the chelant is selected from aminocarboxylate chelants, aminophosphonate chelants, or a mixture thereof.

Preferably, the laundry detergent composition has a pH between 6 and 10, more preferably between 6.5 and 8.9, most preferably between 7 and 8, wherein the pH of the laundry detergent composition is measured as a 10% dilution in demineralized water at 20° C.

The liquid laundry detergent composition may be Newtonian or non-Newtonian. Preferably, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition. When Newtonian the composition may have a viscosity value, at a shear rate of 20s-1 and a temperature of 20° C., of 100 to 3,000 cP, alternatively 200 to 2,000 cP, alternatively 300 to 1,000 cP, following the method described herein. When non-Newtonian, the composition may have a high shear viscosity value, at a shear rate of 20s-1 and a temperature of 20° C., of 100 to 3,000 cP, alternatively 300 to 2,000 cP, alternatively 500 to 1,000 cP, and a low shear viscosity value, at a shear rate of 1 s-1 and a temperature of 20° C., of 500 to 100,000 cP, alternatively 1000 to 10,000 cP, alternatively 1,300 to 5,000 cP, following the method described herein. Methods to measure viscosity are known in the art. According to the present disclosure, viscosity measurements are carried out using a rotational rheometer e.g. TA instruments AR550. The instrument includes a 40 mm 2° or 1° cone fixture with a gap of around 50-60 m for isotropic liquids, or a 40 mm flat steel plate with a gap of 1000 m for particles containing liquids. The measurement is carried out using a flow procedure that contains a conditioning step, a peak hold and a continuous ramp step. The conditioning step involves the setting of the measurement temperature at 20° C., a pre-shear of 10 seconds at a shear rate of 10 s1, and an equilibration of 60 seconds at the selected temperature. The peak hold involves applying a shear rate of 0.05 s1 at 20° C. for 3 min with sampling every 10 s. The continuous ramp step is performed at a shear rate from 0.1 to 1200 s1 for 3 min at 20° C. to obtain the full flow profile.

Use

An aspect of the present invention is the use of a water-soluble unit dose article according to the present invention to reduce instances of residues on fabrics following a fabric wash operation.

Method of Washing

A further aspect of the present invention is a method of washing comprising the steps of adding the water-soluble unit dose article according to the present invention to sufficient water to dilute the laundry detergent composition by a factor of at least 200 fold, preferably between 250 and 3000 fold, more preferably between 250 and 1500 fold, most preferably between 500 and 1500 fold to create a wash liquor and contacting fabrics to be washed with said wash liquor.

Without wishing to be bound by theory, when the water-soluble unit dose article is added to water, the water-soluble film dissolves releasing the internal laundry detergent composition into the water. The laundry detergent composition disperses in the water to create the wash liquor.

Preferably the wash liquor may comprise between 10 L and 75 L, preferably between 20 L and 70 L, more preferably between 30 L and 65 L of water.

Preferably, the wash liquor is at a temperature of between 5° C. and 90° C., preferably between 10° C. and 60° C., more preferably between 12° C. and 45° C., most preferably between 15° C. and 40° C.

Preferably, washing the fabrics in the wash liquor takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably, the wash liquor comprises between 1 kg and 20 kg, preferably between 5 kg and 20 kg, most preferably between 10 and 20 kg of fabrics.

The wash liquor may comprise water of any hardness preferably varying between 0 gpg to 40 gpg.

Process of Making

Those skilled in the art will know how to make a water-soluble unit dose article and laundry detergent composition according to the present invention using techniques known in the art.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

Example 1

A water soluble unit dose pouch residue test was conducted under full scale washing machine conditions following the test method described herein, cross-comparing a 46 ml water soluble unit dose pouch, comprising a detergent to film-ratio according to the invention, with two 23 ml identical water soluble unit dose pouches comprising a film to detergent-ratio outside the scope of the invention. The same detergent composition was used across all water soluble unit dose pouches.

Detergent Composition

TABLE 1

Unit dose detergent composition

| Raw Material | Detergent composition (wt %) |
|---|---|
| C25 HAE2.5S | 14.7 |
| HLAS | 21.55 |
| Lutensol XL 100 | 0.755 |
| Nonionic surfactant (C24-9) | 0.9 |
| Nonionic surfactant (C45-7) | 2.8 |
| Fatty Acid | 5.93 |
| Citric Acid | 0.847 |
| DiPropyleneGlycol (DPG) | 0.16 |
| Glycerine | 4.79 |
| Propanediol | 13.95 |
| Water | 10.59 |
| DTPA | 0.84 |
| Ethoxylated polyethyleneimine (PEI600EO20) | 3.67 |
| Amphiphilic graft copolymer | 3.2 |
| Brightener 49 | 0.188 |
| Monoethanolamine (MEA) | 7.96 |
| Minors (incl. enzymes, anti-foam, anti-oxidant, preservatives, dyes, perfume, . . .) | Balance to 100% |

The above detergent composition was enclosed in a multi-compartment water soluble unit dose pouch according to FIG. 1, using water soluble PVOH film, as supplied by the Monosol company. This pouch has been made through vacuum assisted first film deformation in a first cavity to create the bottom compartment, filling the bottom compartment with detergent composition, and closing the open bottom compartment with the 2 pre-formed closed side by side top compartments. 3 films have consequently been used to generate this pouch, i.e. 2 outer and 1 middle film layer. The outer seal area consequently consists of 3 film layers, the inner seal area between the 2 side by side top compartments comprises 2 film layers. The same pouch shape has been used for inventive and comparative example pouches, the inventive and comparative pouch examples solely differing in relative footprint dimensions to enable different detergent volume enclosure. Comparative and inventive pouch dimensions and detergent to film ratios are described in table 2.

TABLE 2

Unit Dose pouch dimensions

| | Inventive Example | Comparative Example |
|---|---|---|
| Amount of detergent | 46 ml (49.68 g) | 23 ml (24.84 g) |
| Pouch (length * width * height) (excluding flange) | 53 mm * 50 mm * 35 mm | 43 mm * 41 mm * 29 mm |

TABLE 2-continued

| Unit Dose pouch dimensions | | |
|---|---|---|
| | Inventive Example | Comparative Example |
| Film (length * width) - prior to deformation (including flange) | 59 mm * 56 mm | 49 mm * 47 mm |
| Total film weight (3 layers) | 0.97 g | 0.67 g |
| Ratio g detergent:g film ratio | 51.2:1 | 37.1:1 |
| Outside seal area | 654 $mm^2$ | 540 $mm^2$ |
| Inner seal area | 250 $mm^2$ | 150 $mm^2$ |
| Total seal area | 904 $mm^2$ | 690 $mm^2$ |
| Outside seal film weight (3 film layers) | 0.191 g | 0.158 g |
| Inner seal film weight (2 film layers) | 0.049 g | 0.029 g |
| Total seal area/weight | 0.24 g | 0.187 g |
| Ratio g detergent:g film in seal ratio | 207:1 | 132.8:1 |
| Ratio g detergent:g film in outer seal ratio | 260.1:1 | 157.2:1 |

Wash Method

A machine wash test has been conducted cross-comparing use of 1 pouch according to the invention (46 ml) with use of 2 comparative example pouches outside the scope of the invention (2*23 ml=46 ml). This test single variably, i.e. at equal total detergent consumption, simulates the consumer choice of dosing 2 smaller size unit dose pouches outside the scope of the invention, versus 1 larger size unit dose pouch according to the invention, e.g. when facing highly soiled and/or larger size washing loads.

A 20 minutes wash cycle at 20° C. water (hardness: 15 gpg) has been selected on a Electrolux W565H programmable washing machine (programmable Condition 3). The water soluble pouch(es) have been enclosed within an orange knitted cloth (supplied by Calderon; 27×27 cm in size and are preconditioned before use by 2 washes in 15 gpg water at 60 C. and no detergent), i.e. one larger size pouch for the inventive example and 2 smaller size pouches together in one knitted cloth for the comparative example, and washed together with 3 kg of mixed balance load (composition: mixed cotton and polycotton). The orange knitted cloths are consequently cut open and visually inspected for amount of water soluble unit dose pouch residues (without any fabric drying step). The test has been built to enable discrimination of test formulations towards their ability to minimize remaining pouch residues under stretched washing condition (cold water, short cycle, pouch within cloth entrapment).

Test Results

Visual inspection of the cloths post washing demonstrated less water soluble unit dose pouch residues are remaining when the consumer selects one larger unit dose pouch according to the invention.

What is claimed is:

1. A water-soluble multicompartment unit dose article, wherein the water-soluble multicompartment unit dose article comprises:

between about 35 g and about 75 g of a laundry detergent composition, wherein the laundry detergent composition is calculated as the total laundry detergent composition present cumulatively within all the compartments present and the laundry detergent composition is a liquid, a powder, or a mixture thereof, wherein the laundry detergent composition comprises a non-soap surfactant; and at least a first water-soluble film and a second water-soluble film, wherein the first and second water-soluble films are sealed together to create sealed film and wherein the sealed film defines at least a first internal compartment and a second internal compartment; and wherein the weight ratio of laundry detergent to total water-soluble film in the water-soluble multicompartment unit dose article is at least 52.1:1.

2. The water-soluble multicompartment unit dose article according to claim 1 wherein the weight ratio of laundry detergent composition to total sealed film is at least about 150:1, wherein "total sealed film" means the weight of all film present in the water-soluble unit dose article that is present in a seal area, wherein the 'seal area' means areas of film sealed together to define the individual compartments.

3. The water-soluble multicompartment unit dose article according to claim 1 comprising a flange area arranged around the perimeter of the water-soluble multicompartment unit dose article, and wherein the flange area comprises sealed film from at least the first water-soluble film and the second water-soluble film; and wherein the weight ratio of laundry detergent composition to total sealed film in the flange area is at least about 175:1.

4. The water-soluble multicompartment unit dose article according to claim 1 wherein the water-soluble multicompartment unit dose article comprises at least a third water-soluble film wherein at least the first water-soluble film, the second water-soluble film and the third water-soluble film are sealed together to create sealed film.

5. The water-soluble multicompartment unit dose article according to claim 4, wherein the water-soluble multicompartment unit dose article comprises a flange area arranged around the perimeter of the water-soluble multicompartment unit dose article, wherein the flange area comprises sealed film from at least the first water-soluble film, the second water-soluble film and the third water-soluble film.

6. The water-soluble multicompartment unit dose article according to claim 4 wherein the water-soluble multicompartment unit dose article comprises at least two compartments, wherein the compartments are arranged in a side-by-side orientation, a superposed orientation or a mixture thereof.

7. The water-soluble multicompartment unit dose article according to claim 6 wherein the water-soluble multicompartment unit dose article comprises at least three compartments wherein a first and second compartment are arranged in a side-by-side orientation and wherein said first and second compartments are superposed onto a third compartment.

8. The water-soluble multicompartment unit dose article according to claim 4 wherein the water-soluble multicompartment unit dose article, excluding any flange, has a length and a width wherein at least the length or the width, or both the length and the width are independently greater than about 45 mm.

9. The water-soluble multicompartment unit dose article according to claim 8, wherein the water-soluble multicompartment unit dose article, excluding any flange, has a length and a width wherein at least the length or the width, or both the length and the width are independently between about 45 mm and about 70 mm.

10. The water-soluble multicompartment unit dose article according to claim 8, wherein the water-soluble multicompartment unit dose article has a height, wherein the height is greater than about 20 mm.

11. The water-soluble multicompartment unit dose article according to claim 10 wherein the water-soluble multicompartment unit dose article has a height, wherein the height is between about 25 mm and about 50 mm.

12. The water-soluble multicompartment unit dose article according to claim 1 wherein each water-soluble film comprises polyvinyl alcohol polymer or copolymer.

13. The water-soluble multicompartment unit dose article according to claim 1 wherein the non-soap surfactant is selected from non-soap anionic surfactant, non-ionic surfactant or a mixture thereof.

14. The water-soluble multicompartment unit dose article according to claim 13 wherein the non-soap surfactant is present in the laundry detergent composition [comprises] in an amount between about 10% and about 60% by weight of the laundry detergent composition [of the non-soap surfactant].

15. The water-soluble unit dose article according to claim 1 wherein the laundry detergent composition further comprises between about 1.5% and about 20%, by weight of the laundry detergent composition of a fatty acid salt.

16. The water-soluble multicompartment unit dose article according to claim 1 wherein the laundry detergent composition further comprises a non-aqueous solvent selected from the group consisting of 1,2-propanediol, dipropylene glycol, tripropyleneglycol, glycerol, sorbitol, polypropylene glycol or a mixture thereof.

17. The water-soluble multicompartment unit dose article according to claim 16 wherein the liquid laundry detergent composition further comprises between about 10% and about 40%, by weight of the liquid laundry detergent composition of the non-aqueous solvent.

18. The water-soluble multicompartment unit dose article according to claim 1 wherein the liquid laundry detergent composition further comprises between about 0.5% and about 15% by weight of the liquid laundry detergent composition of water.

19. The water-soluble multicompartment unit dose article according to claim 1 wherein the laundry detergent composition has a pH between about 6 and about 10, wherein the pH of the laundry detergent composition is measured as an about 10% dilution in demineralized water at about 20° C.

* * * * *